US006220880B1

(12) United States Patent
Lee et al.

(10) Patent No.: US 6,220,880 B1
(45) Date of Patent: Apr. 24, 2001

(54) ELECTRIC OUTLETS

(76) Inventors: Chiu-Shan Lee; S. S. Chen Li, both of No. 31, Lane 18, Chang-Chun Rd., Hsintien City, Taipei County (TW)

( * ) Notice: Subject to any disclaimer, the term of this patent is extended or adjusted under 35 U.S.C. 154(b) by 0 days.

(21) Appl. No.: 09/492,861

(22) Filed: Jan. 27, 2000

(51) Int. Cl.[7] ..... H01R 4/60
(52) U.S. Cl. ..... 439/214; 439/535
(58) Field of Search ..... 439/107, 172, 439/214, 535, 536, 557, 650

(56) References Cited

U.S. PATENT DOCUMENTS

| | | | | |
|---|---|---|---|---|
| 3,922,478 | * | 11/1975 | Perkey | 174/53 |
| 4,815,983 | * | 3/1989 | Erickson et al. | 439/173 |
| 5,162,616 | * | 11/1992 | Swaffield et al. | 174/99 |
| 5,429,518 | * | 7/1995 | Chen | 439/188 |
| 5,486,979 | * | 1/1996 | Bowen et al. | 361/640 |
| 5,885,109 | * | 3/1999 | Lee et al. | 439/652 |
| 5,934,921 | * | 8/1999 | Doong | 439/172 |

* cited by examiner

*Primary Examiner*—Lincoln Donovan
*Assistant Examiner*—Thanh-Tam Le

(74) *Attorney, Agent, or Firm*—Rosenberg, Klein & Lee

(57) ABSTRACT

An electric outlet includes a socket holder formed of a bottom shell and a top cover shell, a plurality of metal terminal holders respectively installed in the socket holder for connection to power supply, and a plurality of sockets respectively installed in respective socket receiving holes on the top cover shell of the socket holder, each socket including a socket body, the socket body having a top face panel for receiving an electric plug, spring hooks for positioning in one socket receiving hole on the top cover shell, and three bottom through holes, a positive terminal metal contact plate and a negative terminal metal contact plate and a grounding metal contact plate respectively mounted inside the socket body and aimed at respective plug insertion slots on the face panel, a plurality of metal frames mounted inside the socket body and respectively connected to the positive and negative terminal metal contact plates and the grounding metal contact plate, the metal frames each having a horizontal wire hole and a vertical screw hole perpendicularly downwardly extended from the horizontal wire hole and respectively disposed in communication with the bottom through holes on the socket body, and three metal terminals respectively threaded into the vertical screw holes on the metal frames and connected to the terminal holders in the socket holder.

2 Claims, 13 Drawing Sheets

ELECTRIC OUTLETS

BACKGROUND OF THE INVENTION

The present invention relates electric outlets, and more particularly to such electric outlets that fit different electric plugs for use different countries.

The electric outlet of an extension cable is generally comprised of a plurality of socket units for receiving a respective electric plug. The socket units have same specification fitting the electric code of a particular country. This structure of electric outlet cannot be used in different countries having different electric codes. Further each socket unit is designed for receiving a particular electric plug only, i.e., the socket units of the electric outlet cannot fit different electric plugs constructed subject to different electric specifications. For the reason said above, different electric outlets should be provided for use in different countries.

SUMMARY OF THE INVENTION

It is one object of the present invention to provide an electric outlet, which fits different electric plugs for use in different countries. It is another object of the present invention to provide an electric socket for electric outlet, which fits different electric plugs for use in different countries. According to one aspect of the present invention, the electric outlet comprises a socket holder formed of a bottom shell and a top cover shell, a plurality of metal terminal holders respectively installed in the socket holder for connection to power supply, and a plurality of sockets respectively installed in respective socket receiving holes on the top cover shell of the socket holder, each socket including a socket body, the socket body having a top face panel for receiving an electric plug, spring hooks for positioning in one socket receiving hole on the top cover shell, and three bottom through holes, a positive terminal metal contact plate and a negative terminal metal contact plate and a grounding metal contact plate respectively mounted inside the socket body and aimed at respective plug insertion slots on the face panel, a plurality of metal frames mounted inside the socket body and respectively connected to the positive and negative terminal metal contact plates and the grounding metal contact plate, the metal frames each having a horizontal wire hole and a vertical screw hole perpendicularly downwardly extended from the horizontal wire hole and respectively disposed in communication with the bottom through holes on the socket body, and three metal terminals respectively threaded into the vertical screw holes on the metal frames and connected to the terminal holders in the socket holder. According to another aspect of the present invention, the sockets of the electric outlet are made subject to different specifications to fit different electric plugs. According to still another aspect of the present invention, each socket of the electric outlet has different sets of plug insertion slots for receiving any of a variety of electric plugs.

DETAILED DESCRIPTION OF THE PREFERRED EMBODIMENT

Figure 4:
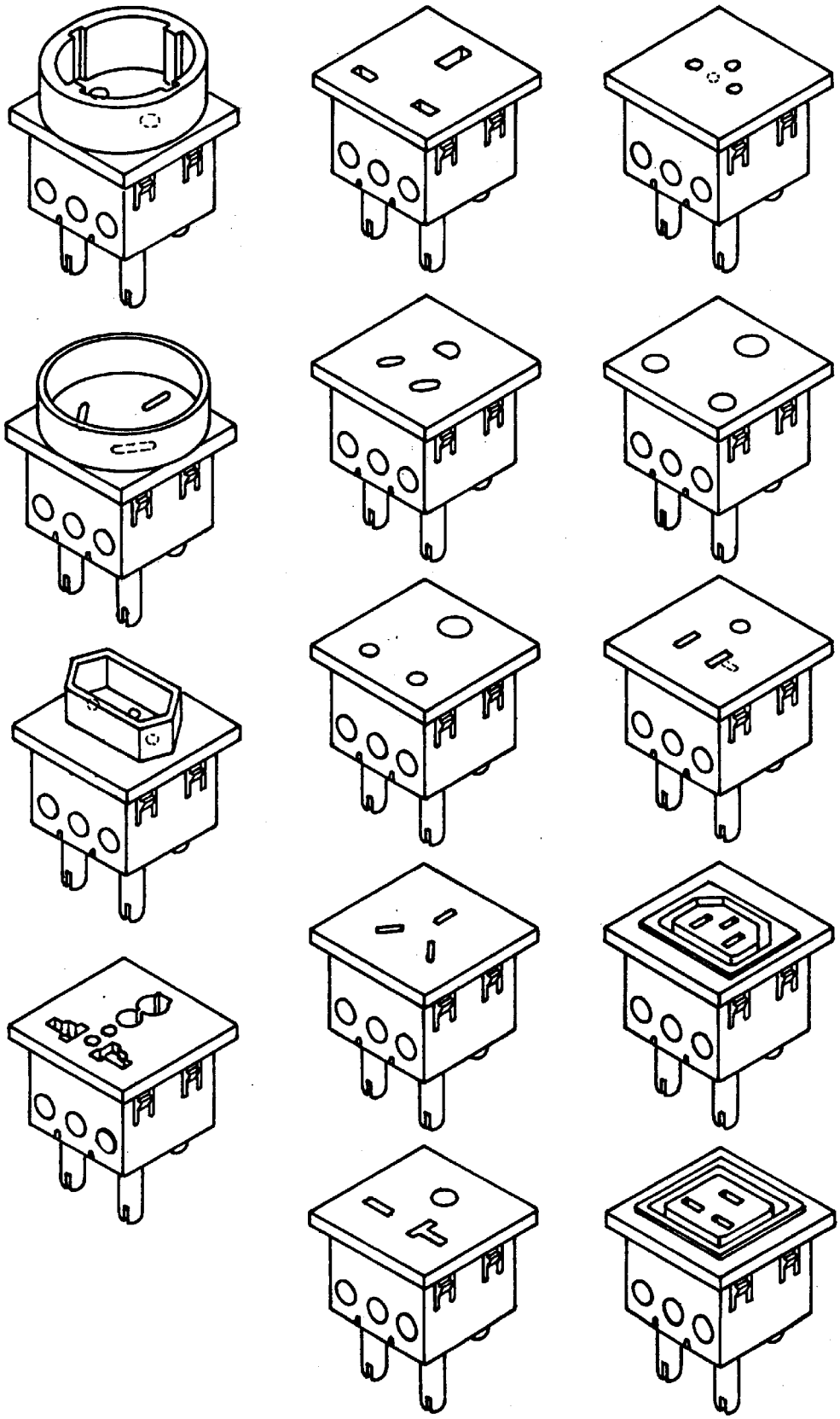
FIG. 4 shows different alternate forms of sockets for the electric outlets shown in FIG. 1.
Figure 5:
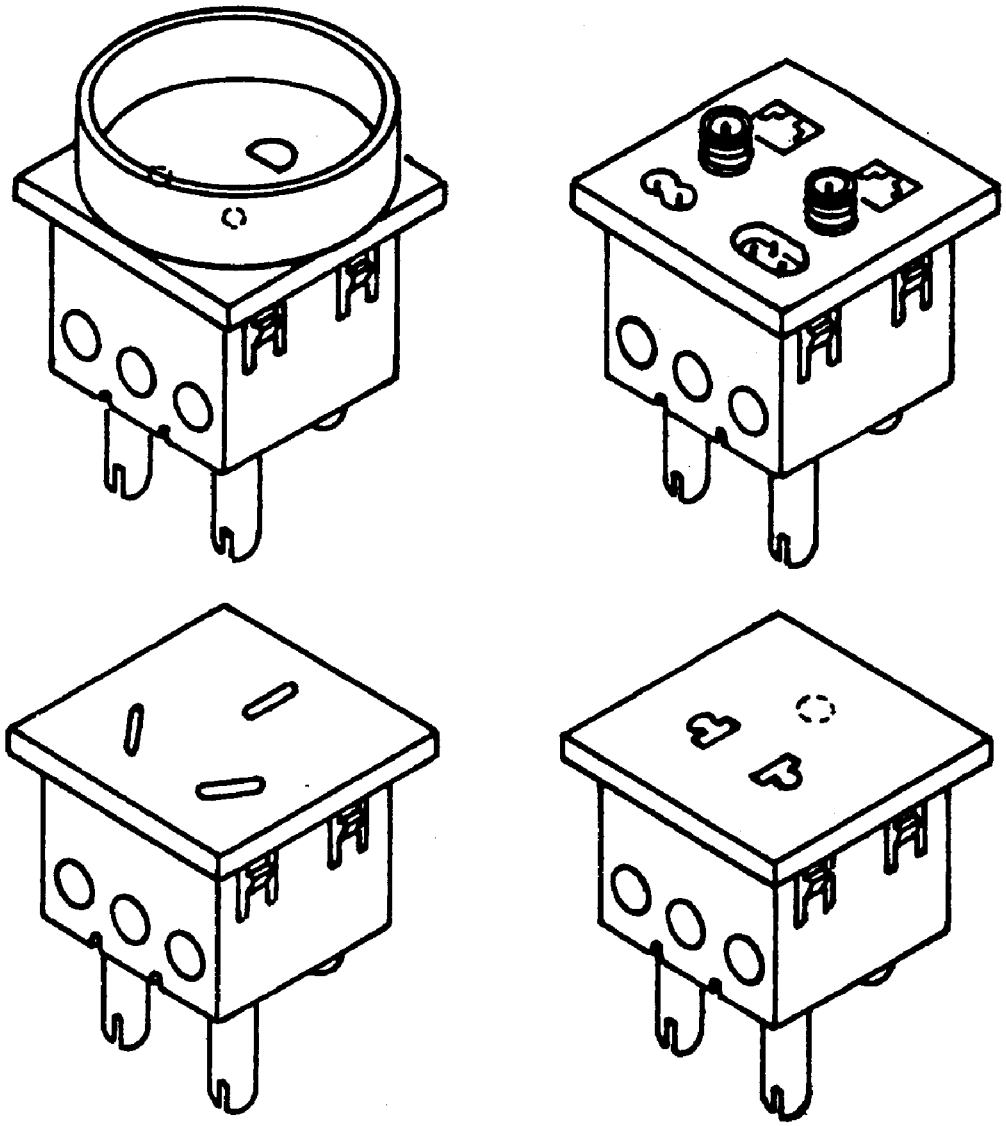
FIG. 5 shows other different alternate form of sockets for the electric outlet shown in FIG. 1.

Referring to FIGS. from 1 through 5, a universal electric outlet is shown comprised of a socket holder 2, and a plurality of sockets 1 respectively installed in the socket holder 2. Each socket 1 comprises a socket body 12, the socket body 12 comprising a face panel 11 horizontally disposed at a top side thereof, and spring hooks 123 formed integral with two opposite lateral side walls thereof for positioning in the socket holder 2, three metal contact plates, namely, the positive and negative terminal metal contact plates 13 and the grounding metal contact plate 14 mounted inside the socket body 12 and respectively aimed at respective plug insertion slots on the face panel 11 of the socket body 12, a plurality of metal frames 124 mounted inside the socket body 12 and respectively connected to the positive and negative terminal metal contact plates 13 and the grounding metal contact plate 14, the metal frames 124 each having a horizontal wire hole 1241 and a vertical screw hole 1242 perpendicularly downwardly extended from the horizontal wire hole 1241 and disposed in communication with a respective through hole (not shown) on the bottom sidewall of the socket body 12, and three cylindrical metal terminals 125 respectively threaded into the vertical screw holes 1242 on the metal frames 124 and extended out of the bottom sidewall of the socket body 12. Each cylindrical metal terminal 125 comprises a threaded top end 1251 threaded into the vertical screw hole 1242 on one metal frame 124, and a slotted bottom end 1252. By means of the slotted bottom end 1252, each cylindrical metal terminal 125 can be positively driven into the vertical screw hole 1242 on one metal frame 124 with a screwdriver. The socket holder 2 comprises an electrically insulative bottom shell 23 having sets of receptacles 231, three wire conductors 2321, three sets of metal terminal holders 232 respectively installed in the receptacles 231, the terminal holders 232 of the same set being connected to one another by one wire conductor 2321, an electrically insulative partition board 22 mounted within the bottom shell 23 above the receptacles 231 and the terminal holders 231 in the receptacles 231, the partition board 22 having sets of through holes 221 corresponding to the receptacles 231, a power cord 233 extended out of the bottom shell 23 for guiding to AC power supply to the wire conductors 2321, and a top cover shell 21 covered on the bottom shell 23, the top cover shell 21 having a plurality of socket receiving holes 211 for receiving the sockets 1. The sockets 1 are respectively installed in the socket receiving holes 211 in the top cover shell 21. After installation of one socket 1 in one socket receiving hole 211, the spring hooks 123 are forced into engagement with an inside wall of the top cover shell 21 to hold the socket 1 in position, and the cylindrical metal terminals 125 of the socket 1 are respectively inserted through three through holes 221 on the partition board 22 into three metal terminal holders 232. The face panels 11 of the sockets 1 may be variously embodied to fit different electric codes in different countries. FIGS. 4 and 5 show different alternate forms of the socket for use in different countries.

Figure 6:
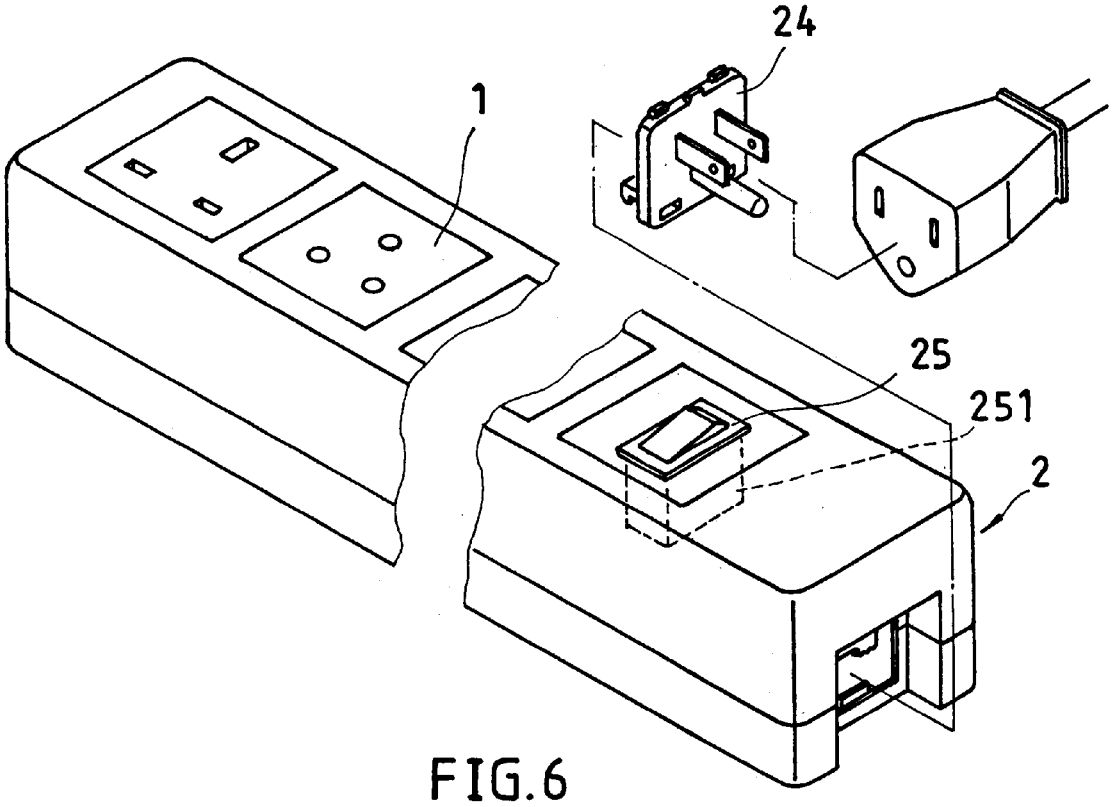
FIG. 6 shows the socket holder provided with an on/off switch according to the present invention.

Referring to FIG. 6, the socket holder 2 is provided with an on/off switch 25 having a fuseless circuit breaker 251 for power on/off switching control.

Figure 7:
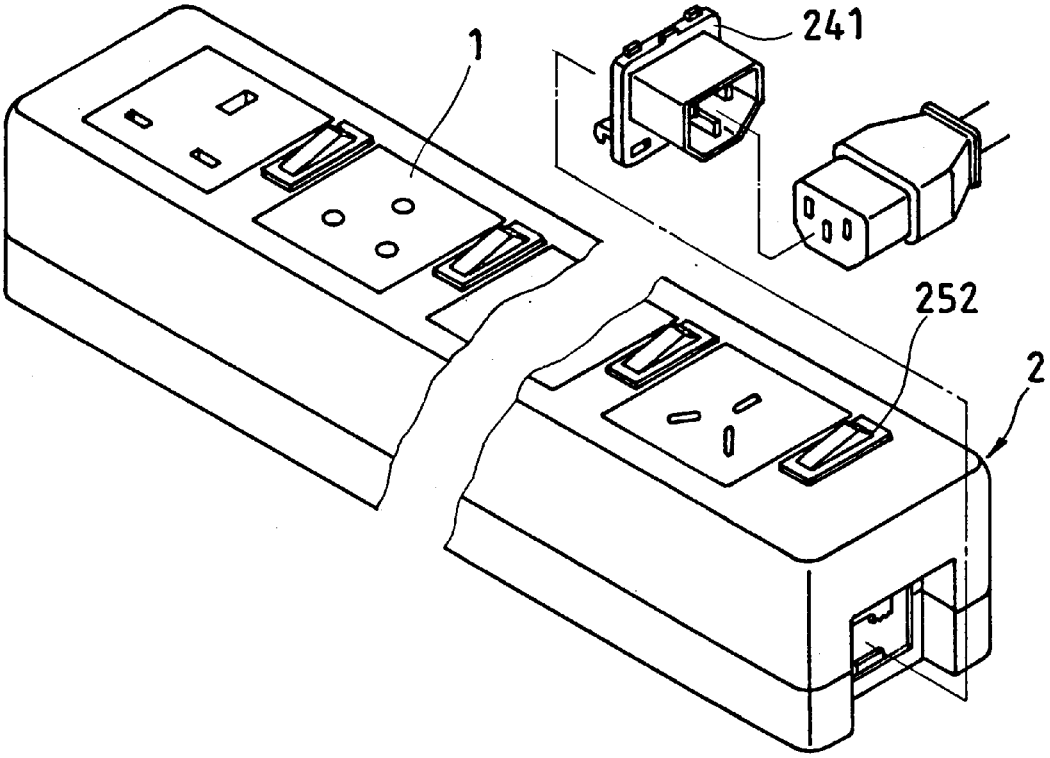
FIG. 7 shows the socket holder provided with a plurality of on/off switches corresponding to the sockets according to the present invention.

Referring to FIG. 7, a plurality of on/off switches 252 are respectively installed in the socket holder 2 for operation by hand to switch on/off the sockets 1 respectively.

Figure 8:
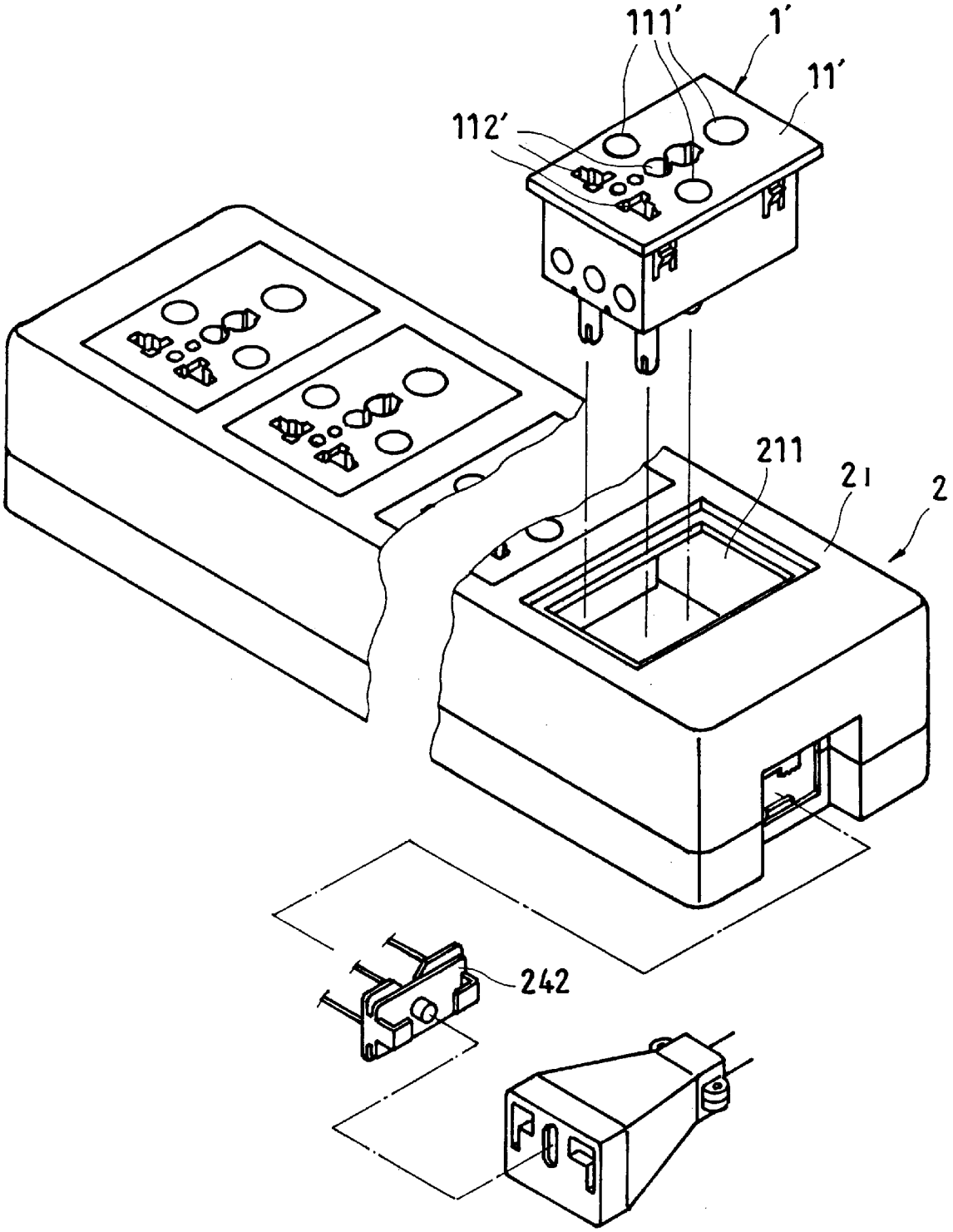
FIG. 8 is an exploded view of an alternate form of the electric outlet according to the present invention.
Figure 9:
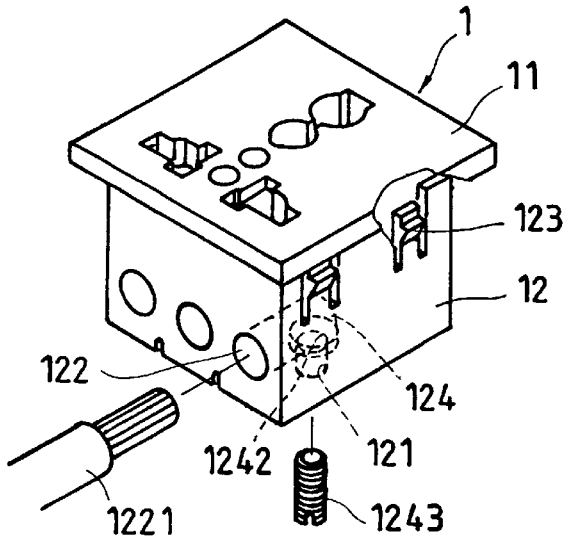
FIG. 9 illustrates the installation of an electric wire in a socket according to the present invention.

Referring to FIG. 8, the face panel 11' of the socket 1' comprises plug insertion slots 111' subject to South Africa specifications and universal plug insertion holes 112' for different electric plugs.

Figure 1:
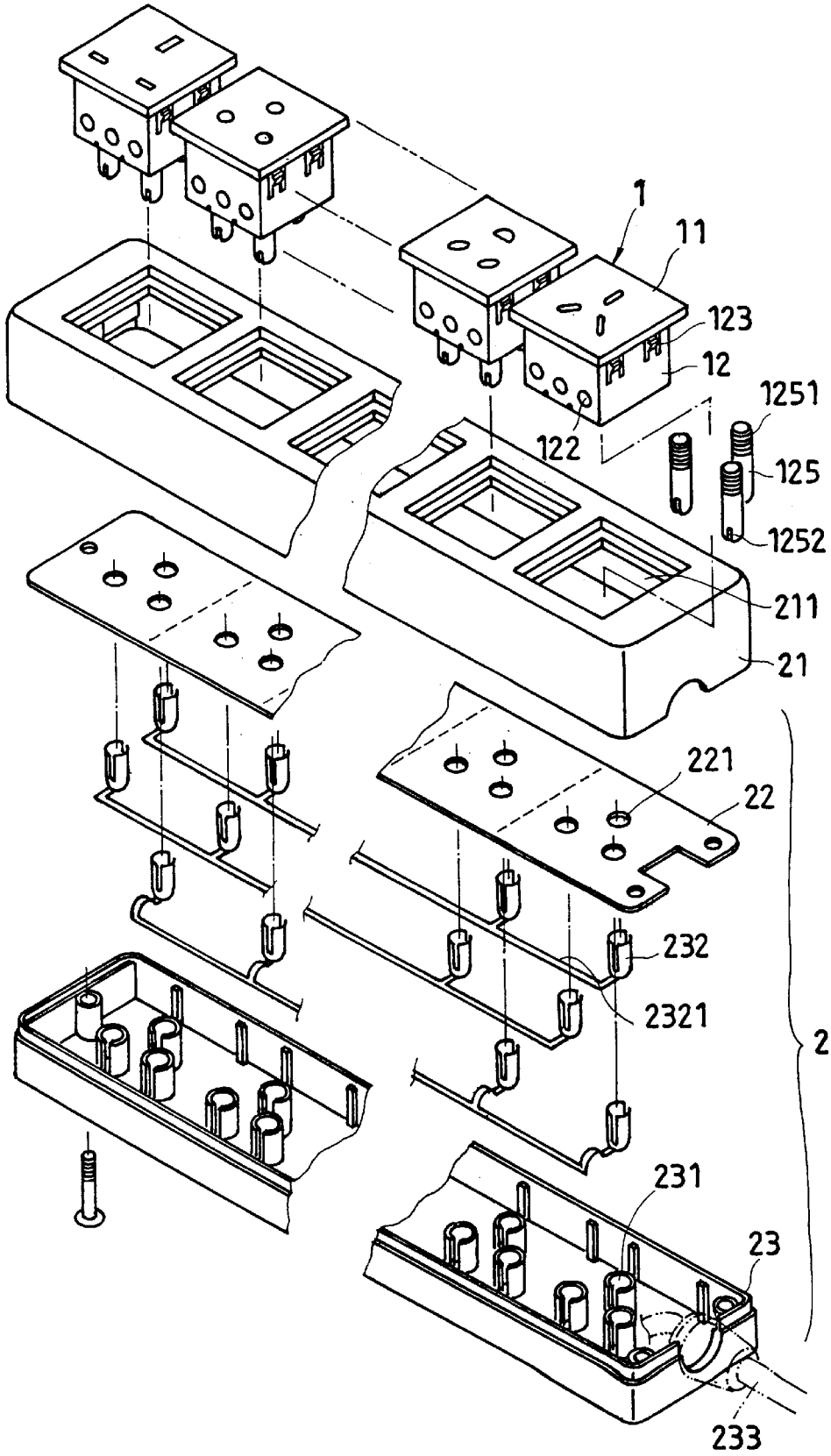
FIG. 1 is an exploded view of an electric outlet according to one embodiment of the present invention.
Figure 2:
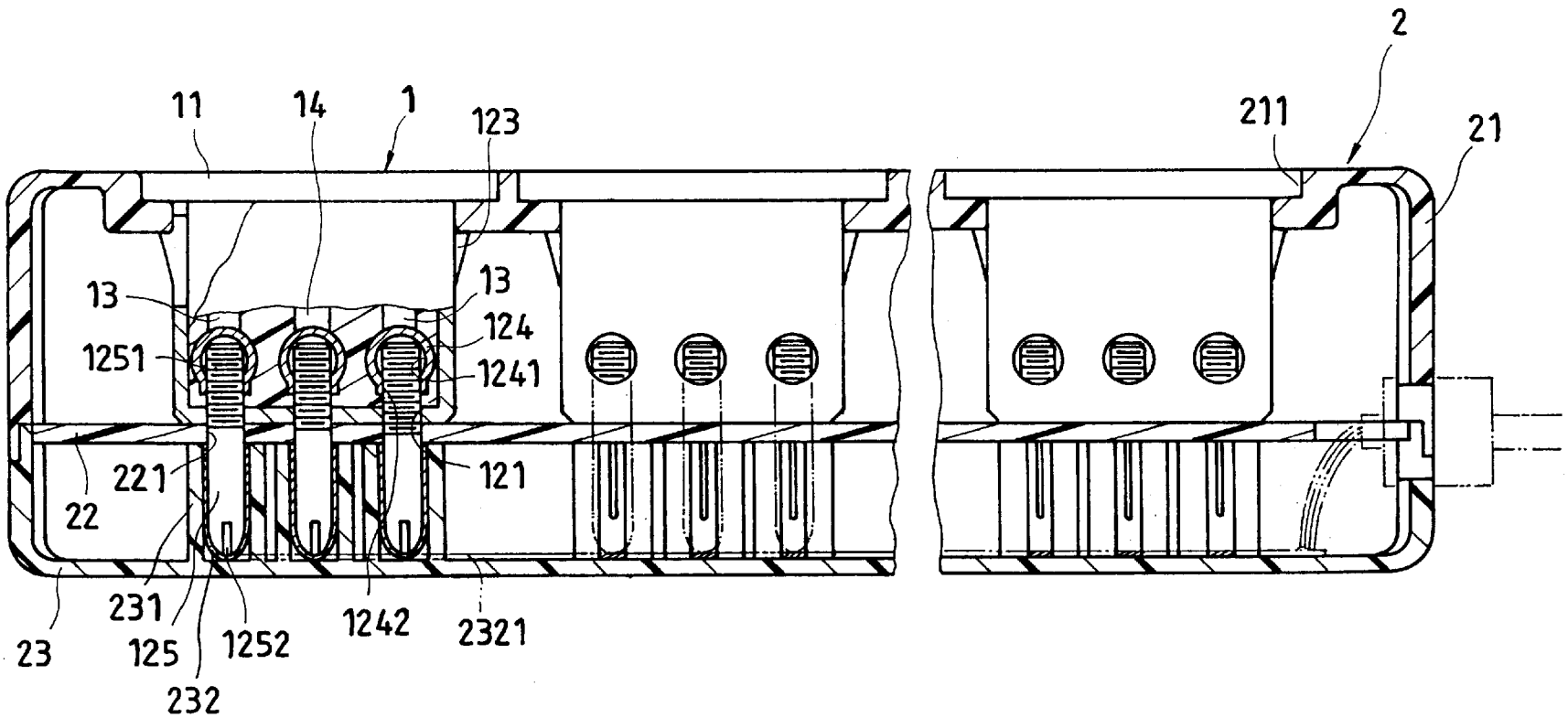
FIG. 2 is a sectional assembly view in an enlarged scale of the electric outlet shown in FIG. 1.
Figure 3:
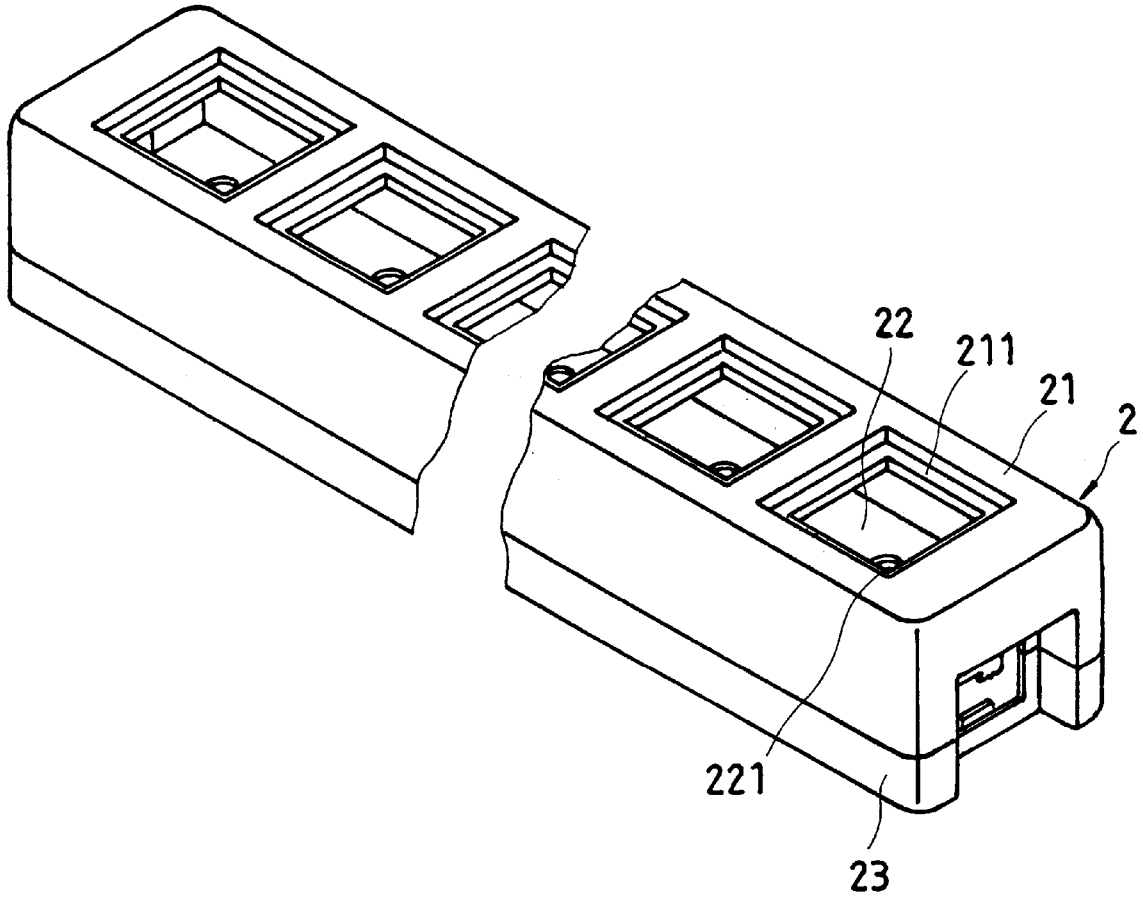
FIG. 3 is an elevational view of the electric outlet shown in FIG. 1 when assembled.

Referring to FIGS. from 6 through 8 again, any of a variety of electric connectors 24, 241 or 242 may be installed in the socket holder 2 and connected to the wire conductors 2321 to receive a power cord 233 (see also FIG. 1).

Figure 11:
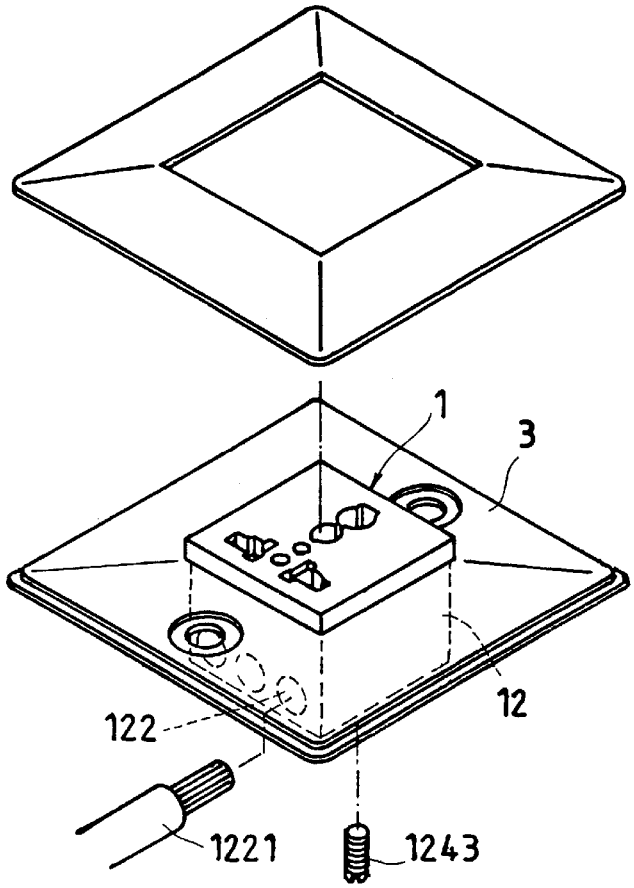
FIG. 11 shows a socket installed in a wall plate according to the present invention.
Figure 12:
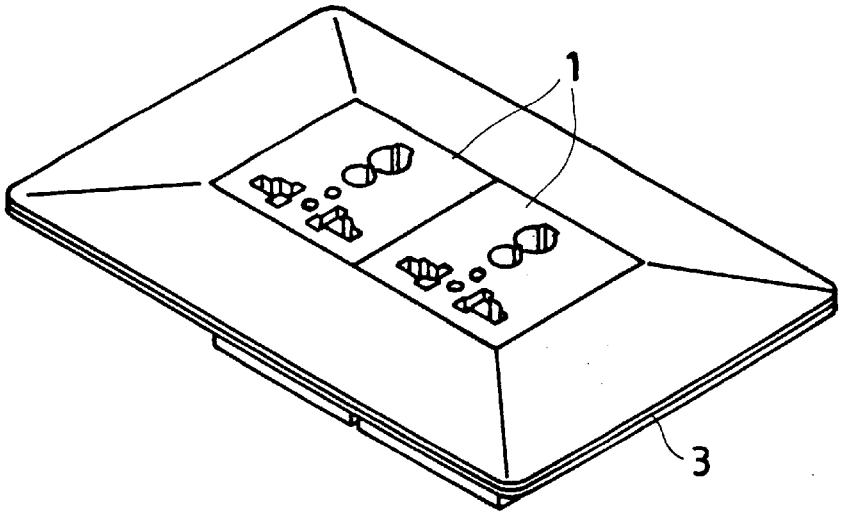
FIG. 12 shows two sockets installed in a wall plate according to the present invention.
Figure 10:
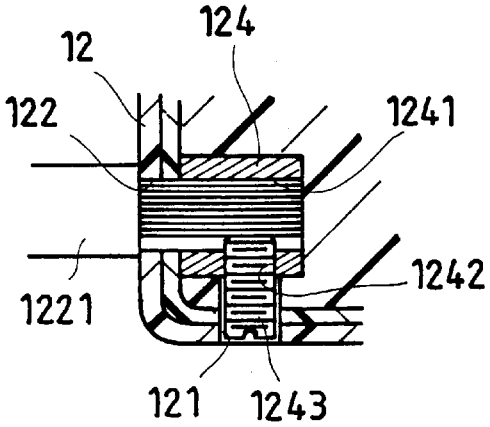
FIG. 10 is a sectional view of a part of the socket shown in FIG. 9, showing the electric wire installed.
Figure 13:
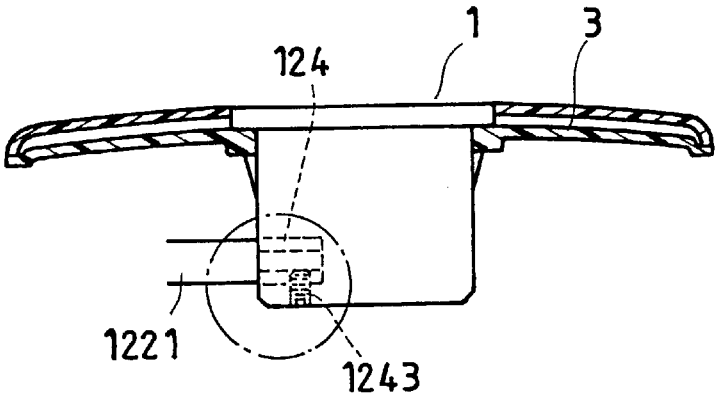
FIG. 13 is a sectional assembly view of FIG. 11.
Figure 14:
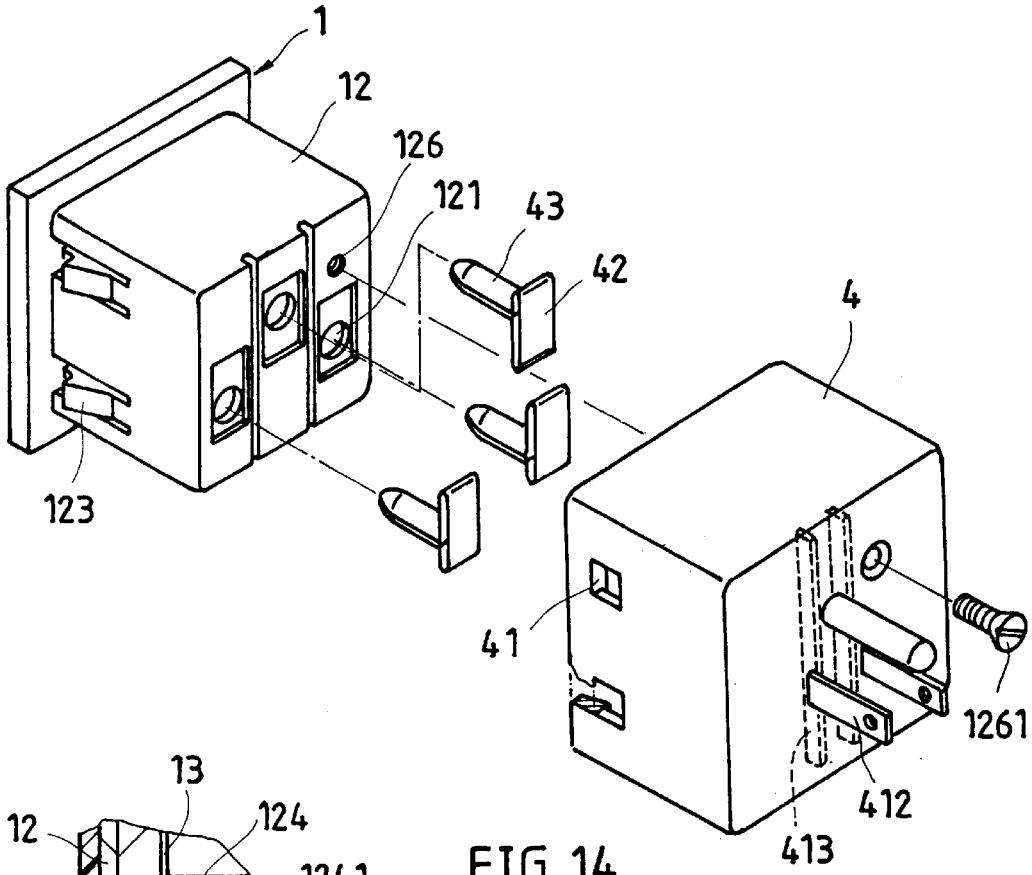
FIG. 14 is an exploded view of a socket and an adapter according to the present invention.
Figure 16:
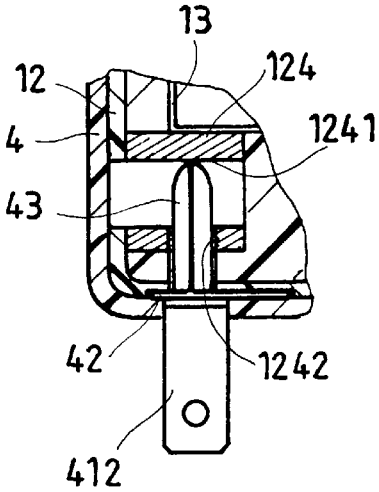
FIG. 16 is an enlarged view of a part of FIG. 15 when viewed from another side.
Figure 15:
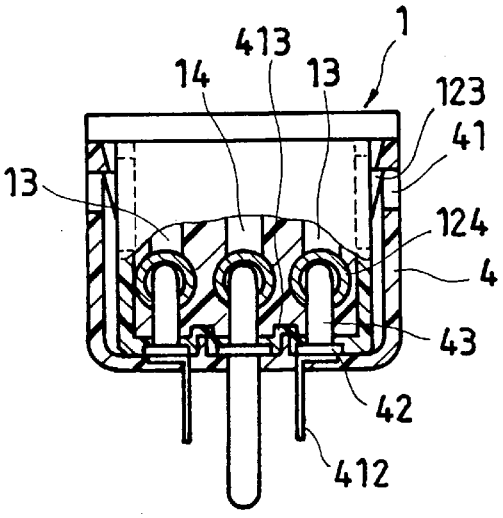
FIG. 15 is a side view in section of the assembly of FIG. 14.
Figure 17:
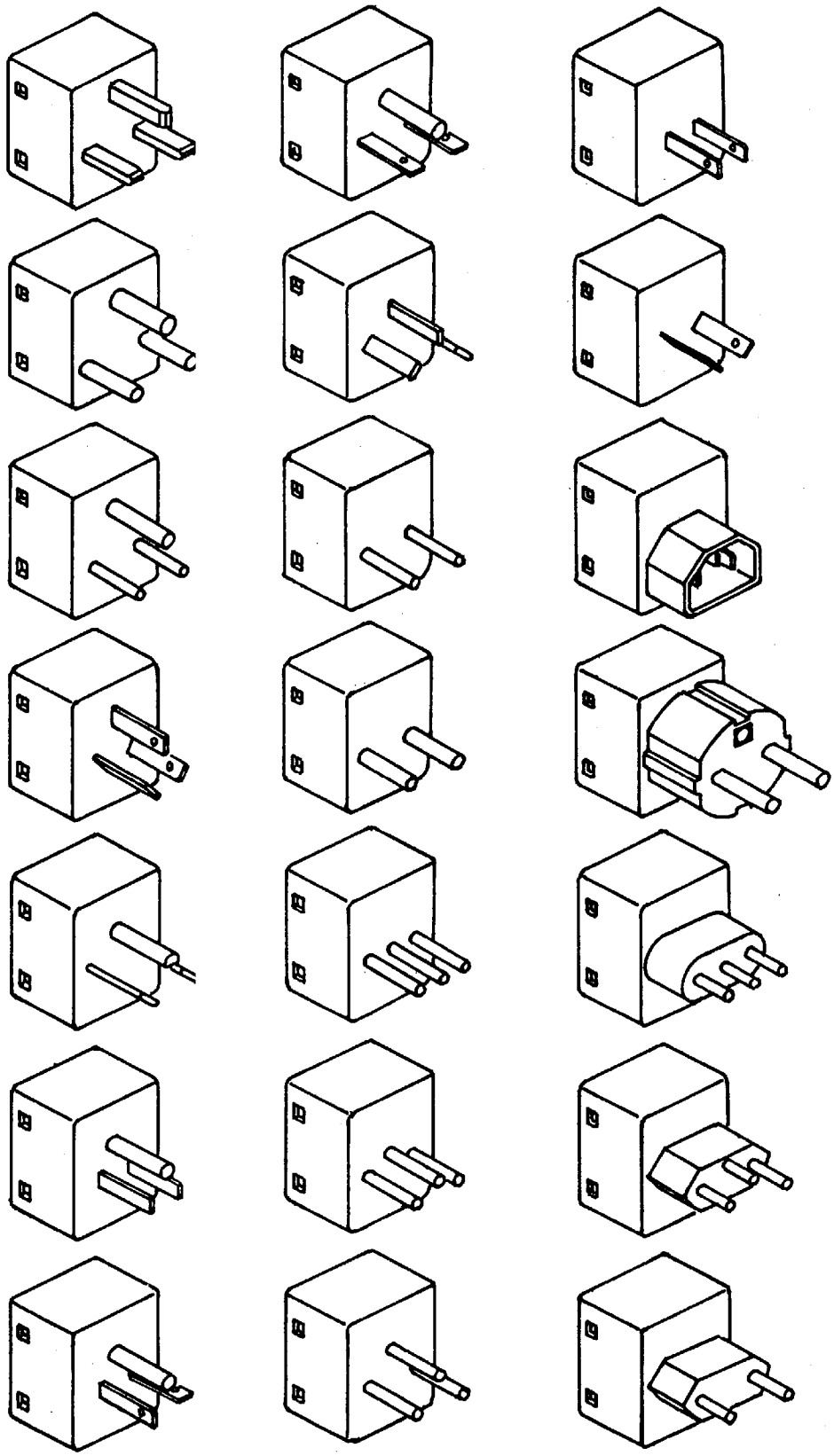
FIG. 17 illustrates different alternate forms of adapters according to the present invention.

Referring to FIGS. from 9 through 12, the electric wires 1221 are respectively inserted through respective wire holes 122 on one vertical side wall of the socket body 12 of the socket 1 into the respective wire holes 1241 on the metal frames 124, and holding down screws 1243 are respectively threaded into the vertical screw holes 1242 on the metal frames 124 to fix the electric wires 1221 to the respective metal frames 124. In FIG. 11, one socket 1 is installed in a wall plate 3. In FIG. 12, two sockets 1 are installed in a wall plate 3.

Referring to FIGS. from 14 through 17, the socket 1 comprises three insertion holes 121 and a screw hole 126 on the bottom sidewall thereof. Three metal spring plates 42 are installed in the bottom sidewall of the socket 1. The metal spring plates 42 each have a plug rod 43 inserted through one insertion hole 121 into the vertical screw hole 1242 on one metal frame 124 inside the socket 1. An adapter 4 is coupled to the socket body 12 of the socket 1. The adapter 4 comprises a plurality of retaining holes 41 respectively fastened to the spring hooks 123 at the socket body 12 of the socket 1, and metal blades 414 for connection to an electric socket to transmit power supply to the socket 1. After installation of the adapter 4, a screw 1241 is mounted in a countersunk hole on the adapter 4 and threaded into the screw hole 126 to fixedly secure the adapter 4 to the socket 1. Further, partition ribs 413 are provided inside the adapter 4 to separate the metal blades 412. The metal blades 412 of the adapter 4 may be variously embodied to fit different electric codes in different countries (see AFIG. 17).

Figure 18:
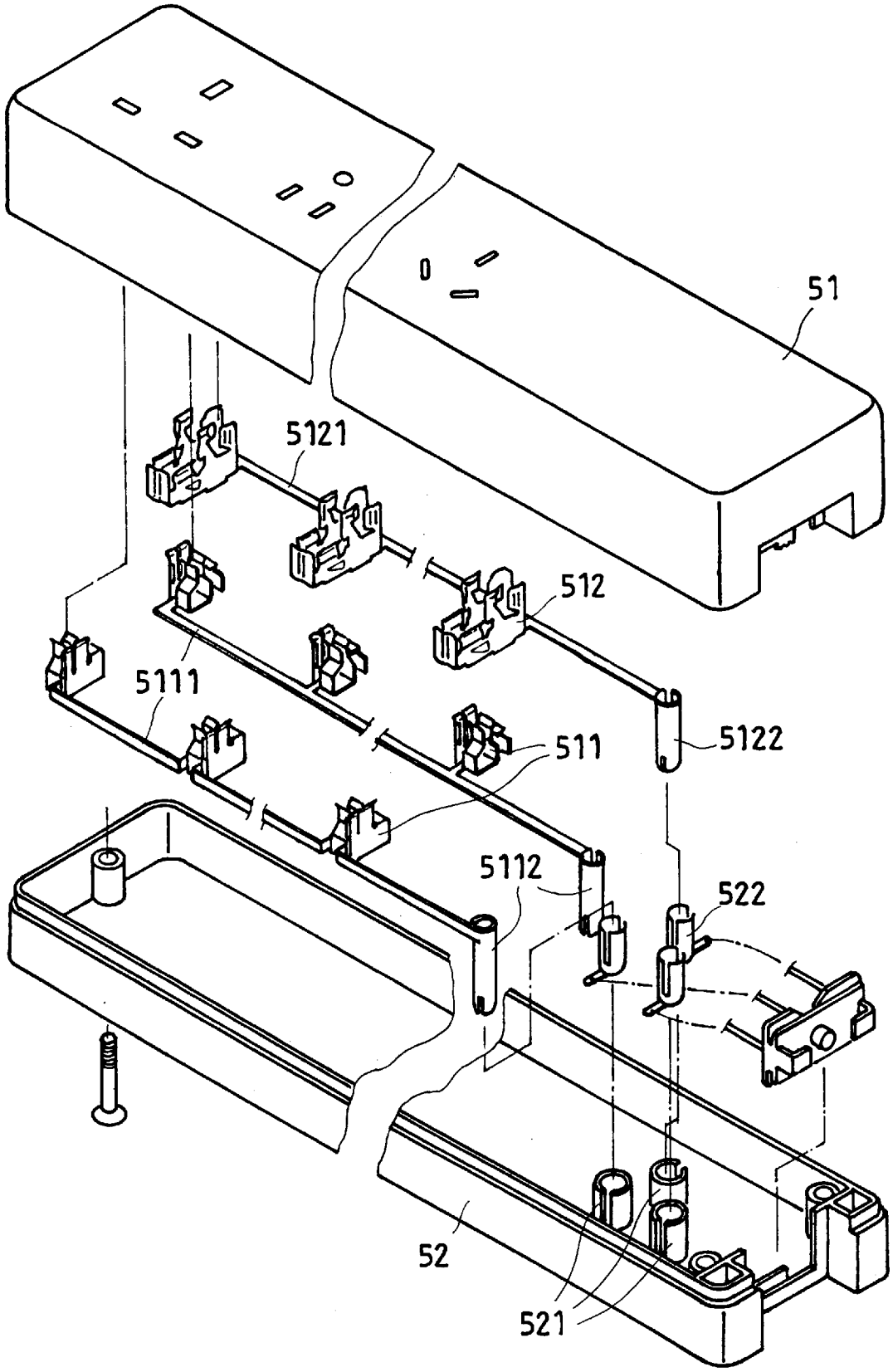
FIG. 18 is an exploded view of another alternate form of the electric outlet according to the present invention.
Figure 19:
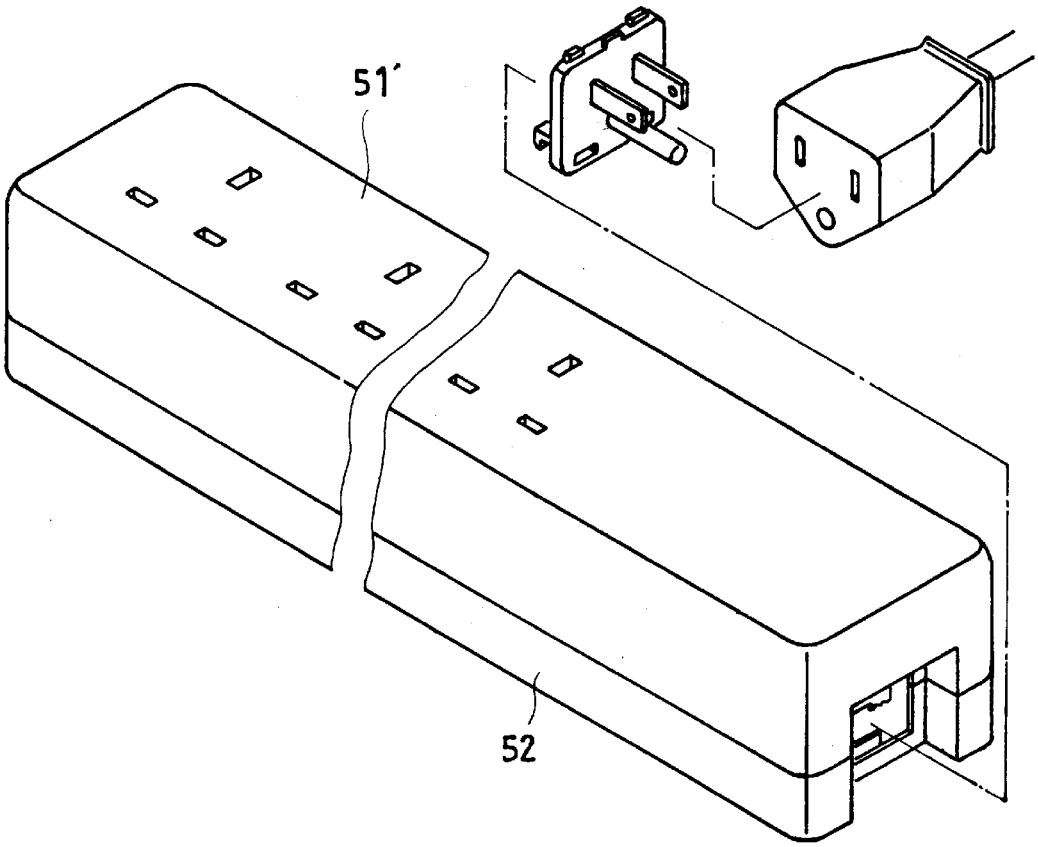
FIG. 19 is an exploded view of the embodiment shown in FIG. 18 where the top cover shell is provided for inserts of plugs having the same insert configuration.

Referring to FIGS. 18 and 19, the electric outlet according to this alternate form comprises an electrically insulative bottom shell 52 having three receptacles 521 disposed near one end, an electrically insulative top cover shell 51 covered on the bottom shell 52, three metal clamps 522 respectively installed in the receptacles 521 and connected to an electric connector for receiving a power cord, positive and negative terminal lines 5111 and a grounding line 5121 respectively arranged in the bottom shell 52, the terminal lines 511 and grounding line 5121 have a respective plug portion 5112 disposed at one end and respectively fastened to the metal clamps 622 in the receptacles 521, positive terminal and negative terminal contact frames 511 and grounding contact frames 512 respectively provided at the positive and negative terminal lines 5111 and grounding line 5121 corresponding to plug insertion slots on the top cover shell 51. In FIG. 18, the top cover shell 51 is provided with different plug insertion slots for receiving different electric plugs. In FIG. 19, the top cover shell 51 is provided with multiple sets of plug insertion slots of same specification.

It is to be understood that the drawings are designed for purposes of illustration only, and are not intended for use as a definition of the limits and scope of the invention disclosed.

What the invention claimed is:

1. An electric outlet comprising:

a socket holder, said socket holder including an electrically insulative bottom shell, an electrically insulative top cover shell covered on said bottom shell, said top cover shell having at least one socket receiving hole;

a plurality of metal terminal holders respectively installed in said bottom shell for connection to a power supply;

at least one socket respectively installed in said at least one socket receiving hole on said top cover shell, said at least one socket including a socket body, said socket body including (a) a face panel horizontally disposed at a top side thereof for receiving an electric plug, (b) spring hooks formed integral with two opposite lateral side walls thereof for positioning said socket body in one socket receiving hole on said top cover shell, (c) three through holes on a bottom side wall thereof, (d) a positive terminal metal contact plate and a negative terminal metal contact plate and a grounding metal contact plate respectively mounted inside said socket body and directed toward respective plug insertion slots formed in said face panel, (e) a plurality of metal frames mounted inside said socket body and respectively connected to said positive and negative terminal metal contact plates and said grounding metal contact plate, said metal frames each having formed therein a horizontal wire hole and a vertical screw hole extending perpendicularly downwardly from said horizontal wire hole and each being respectively disposed in communication with said through holes in said side wall of said socket body, and (f) three metal terminals respectively threaded into said vertical screw holes of said metal frames and connected to said plurality of metal terminal holders; and, three wire conductors installed in said bottom shell and respectively connected to said metal terminal holders to keep said metal terminal holders in three separated series.

2. An electric outlet comprising:

a socket holder, said socket holder including an electrically insulative bottom shell, an electrically insulative top cover shell covered on said bottom shell, said top cover shell having at least one socket receiving hole;

a plurality of metal terminal holders respectively installed in said bottom shell for connection to a power supply;

at least one socket respectively installed in said at least one socket receiving hole on said top cover shell, said at least one socket including a socket body, said socket body including (a) a face panel horizontally disposed at a top side thereof for receiving an electric plug, (b) spring hooks formed integral with two opposite lateral side walls thereof for positioning said socket body in one socket receiving hole on said top cover shell, (c) three through holes on a bottom side wall thereof, (d) a positive terminal metal contact plate and a negative terminal metal contact plate and a grounding metal contact plate respectively mounted inside said socket body and directed toward respective plug insertion slots formed in said face panel, (e) a plurality of metal frames mounted inside said socket body and respectively connected to said positive and negative terminal metal contact plates and said grounding metal contact plate, said metal frames each having formed therein a horizontal wire hole and a vertical screw hole extending perpendicularly downwardly from said horizontal wire hole and each being respectively disposed in communication with said through holes in said side wall of said socket body, and (f) three metal terminals respectively threaded into said vertical screw holes of said metal frames and connected to said plurality of metal terminal holders, each of said metal terminals of said at least one socket having a threaded portion at a top end thereof threaded into said vertical screw hole of a respective one of said metal frames and a slotted bottom end portion extending out from said bottom side wall of said socket.

* * * * *